US012083392B2

(12) United States Patent
McLoughlin

(10) Patent No.: US 12,083,392 B2
(45) Date of Patent: Sep. 10, 2024

(54) GOLF BALL MARKER AND ALIGNMENT TOOL

(71) Applicant: Enda McLoughlin, Wicklow (IE)

(72) Inventor: Enda McLoughlin, Wicklow (IE)

( * ) Notice: Subject to any disclaimer, the term of this patent is extended or adjusted under 35 U.S.C. 154(b) by 395 days.

(21) Appl. No.: 17/417,415

(22) PCT Filed: Oct. 7, 2020

(86) PCT No.: PCT/EP2020/078181

§ 371 (c)(1),
(2) Date: Jun. 23, 2021

(87) PCT Pub. No.: WO2021/069529

PCT Pub. Date: Apr. 15, 2021

(65) Prior Publication Data

US 2022/0072387 A1 Mar. 10, 2022

(30) Foreign Application Priority Data

Oct. 8, 2019 (GB) ..... 1914515

(51) Int. Cl.

| | |
|---|---|
| ***A63B 69/36*** | (2006.01) |
| ***A63B 43/00*** | (2006.01) |
| ***A63B 45/02*** | (2006.01) |
| ***A63B 57/30*** | (2015.01) |

(52) U.S. Cl.

CPC ..... *A63B 45/02* (2013.01); *A63B 43/008* (2013.01); *A63B 57/353* (2015.10); *A63B 69/3655* (2013.01); *A63B 69/3688* (2013.01)

(58) Field of Classification Search

CPC ..... A63B 69/3629; A63B 69/3655; A63B 69/3667; A63B 69/3682; A63B 69/3676

See application file for complete search history.

(56) References Cited

U.S. PATENT DOCUMENTS 2,150,580 A * 3/1939 Crowley ..... A63B 69/3667 33/508
3,934,882 A * 1/1976 Whittaker ..... A63B 57/00 473/267
4,765,625 A * 8/1988 Miner ..... A63B 69/3667 473/218

(Continued)

FOREIGN PATENT DOCUMENTS

CA 2349464 A1 * 12/2002 ..... A63B 57/207
GB 2245838 A * 1/1992 ..... A63B 69/3667

(Continued)

OTHER PUBLICATIONS

Combined Search and Examination Report in UK Patent Application No. GB1914515.0 mailed on Feb. 26, 2020.

(Continued)

*Primary Examiner* — Alvin A Hunter

(74) *Attorney, Agent, or Firm* — Schmeiser, Olsen & Watts LLP

(57) ABSTRACT

A golf ball alignment tool (100) for assisting a golfer in visually aligning a golf ball (200) with a golf hole (114), the tool comprising a support base (101) and an alignment indicator (102), wherein the alignment indicator (102) is mounted on the support base (101) and moveable relative thereto to allow adjustment of the alignment indicator (102) without movement of the support base (101).

18 Claims, 10 Drawing Sheets

(56) References Cited

U.S. PATENT DOCUMENTS 5,332,211 A * 7/1994 Rife ..... A63B 69/3676 473/258
5,409,231 A * 4/1995 Kueng ..... A63B 69/3676 473/157
D361,355 S 8/1995 Hummer
5,437,446 A * 8/1995 Youngkin ..... A63B 57/353 473/409
5,443,265 A * 8/1995 Wheeler ..... A63B 69/3676 473/257
5,607,360 A * 3/1997 Shiffman ..... A63B 69/3676 473/180
5,662,535 A * 9/1997 Smith ..... A63B 69/3676 473/404
5,779,557 A * 7/1998 Scannell ..... A63B 69/3667 473/409
5,792,015 A * 8/1998 Hoyt ..... G01C 9/12 33/391
6,019,685 A * 2/2000 Fonseca ..... A63B 69/3676 473/267
6,036,608 A * 3/2000 Morris ..... A63B 63/00 473/220
6,769,995 B1 * 8/2004 Rhodes ..... A63B 69/36211 473/278
6,840,870 B1 * 1/2005 Froggatte ..... A63B 24/0003 473/265
6,869,288 B1 * 3/2005 Faulkner ..... A63B 69/3676 473/277
7,527,562 B1 * 5/2009 Mason ..... A63B 69/3667 473/270
D616,953 S 6/2010 Shinki
D622,799 S 8/2010 Cameron
7,789,742 B1 * 9/2010 Murdock ..... G16H 40/67 463/2
7,815,516 B1 * 10/2010 Mortimer ..... A63B 24/0021 473/257
7,942,754 B1 * 5/2011 Miller, Jr. ..... A63B 57/40 473/175
D654,977 S 2/2012 Conable
D661,761 S 6/2012 Cameron
D669,551 S 10/2012 Perez
8,939,852 B1 * 1/2015 Waggoner ..... A63B 69/3676 473/404
D736,334 S 8/2015 Perry
D859,556 S 9/2019 Kumpis
D875,866 S 2/2020 McIlvain
D882,709 S 4/2020 Mickley
10,695,642 B1 * 6/2020 Robinson ..... A63B 69/3661
D891,553 S 7/2020 Clift
D896,907 S 9/2020 Clift
11,278,779 B2 * 3/2022 Gardner ..... A63B 57/353
2001/0003104 A1 * 6/2001 Binduga ..... A63B 69/3667 473/262
2002/0086741 A1 * 7/2002 Newcomb ..... A63B 43/008 473/351
2003/0148815 A1 * 8/2003 Swistock ..... A63B 69/3682 473/262
2003/0148817 A1 * 8/2003 Swistock ..... A63B 69/3661 473/278
2005/0009645 A1 * 1/2005 Isabell ..... A63B 69/3694 473/400
2006/0063604 A1 * 3/2006 Amerson ..... A63B 69/3621 473/278
2007/0173339 A1 * 7/2007 Rivard ..... A63B 69/3676 473/270
2008/0020865 A1 * 1/2008 Mitsuba ..... A63B 37/0003 473/378
2009/0305818 A1 12/2009 Cameron
2010/0035699 A1 * 2/2010 Sorenson ..... A63B 69/3621 473/278
2010/0095858 A1 4/2010 Krikorian
2010/0222160 A1 * 9/2010 Williams ..... A63B 57/353 473/409
2010/0222161 A1 * 9/2010 Williams ..... A63B 69/3676 473/409
2011/0053711 A1 * 3/2011 Trafford ..... A63B 57/207 473/406
2014/0155187 A1 * 6/2014 Spelman ..... A63B 69/3685 473/220
2015/0045131 A1 2/2015 Hornung
2015/0148144 A1 * 5/2015 Freund ..... A63B 69/3676 473/257
2016/0038816 A1 * 2/2016 Taft ..... A63B 69/3623 473/218
2016/0045804 A1 * 2/2016 Lynch ..... A63B 69/3676 29/428
2017/0056747 A1 * 3/2017 Merwin ..... A63B 69/3676
2018/0154237 A1 * 6/2018 Beloin ..... A63B 69/3676
2018/0154238 A1 * 6/2018 Beloin ..... A63B 69/3676
2018/0345112 A1 * 12/2018 Björkdahl ..... A63B 69/3676
2018/0353830 A1 * 12/2018 Jacques ..... A63B 57/00
2019/0217180 A1 * 7/2019 Collins ..... A63B 69/3621
2019/0240556 A1 * 8/2019 Flores ..... A63B 69/3676
2019/0282871 A1 9/2019 Peterson et al.
2020/0129833 A1 * 4/2020 Cooper ..... A63B 69/3676

FOREIGN PATENT DOCUMENTS

GB 2312850 A * 11/1997 ..... A63B 69/3667
GB 2369580 A * 6/2002 ..... A63B 69/3644
KR 940003208 Y1 * 5/1994
KR 200430361 Y1 * 11/2006
KR 100903733 B1 * 6/2009
KR 20130039913 A 4/2013
KR 101261896 B1 * 5/2013
KR 101980597 B1 * 5/2019
WO WO-03097182 A1 * 11/2003 ..... A63B 24/0003
WO 2011028910 A1 3/2011
WO 2020160162 A1 8/2020

OTHER PUBLICATIONS

International Search Report and Written Opinion in PCT/EP2020/078181 mailed on Feb. 12, 2021.
Restriction/Election Requirement in U.S. Design Patent Application No. 35/508,159, mailed on Nov. 10, 2020.

* cited by examiner

GOLF BALL MARKER AND ALIGNMENT TOOL

FIELD OF THE INVENTION

The present invention relates to the game of golf and more particularly to a golf ball alignment tool for aligning a golf ball with a golf hole.

BACKGROUND TO THE INVENTION

When playing golf up to four players play each hole together. Usually all players in a playing group are allowed to reach the green prior to any of the players putting their ball into the golf hole. Generally the player furthest from the golf hole is allowed to putt first. It often occurs that another player's golf ball is positioned between the active player's golf ball and the golf hole such that there is a chance that the golf balls may collide. In order to avoid a collision between the golf balls it is customary for the golf ball which is positioned between the active player's golf ball and the golf hole to be removed and the spot where it was positioned marked with a marker.

Golf ball markers may be circular coins or plastic discs with substantially the same characteristics of circular coins which mark the position of the removed golf ball. Alternatively plastic or metal discs which have a portion which corresponds to the contours of the golf ball is removed. These type of markers are moved flush to the golf ball such that the removed portion fits snugly to the golf ball.

Putting in golf is considered to be one of the most difficult aspects of the game. When attempting to putt the golf ball such that it drops into the golf hole the golfer will typically align their putt taking into account any slope or undulations of the green. It is not unusual for golfers to mark a golf ball with a straight line which they can then use to align their putt.

Patent application WO2011/028910 describes a golf ball marking tool and alignment tool. In each embodiment therein the tool comprises an elongate body portion which defines opposed, generally planar first (top) and second (bottom) surfaces, and a longitudinal axis. Disposed on the top surface and extending along at least a portion of the length of the longitudinal axis is an alignment line. The alignment line preferably extends along the entire length of the longitudinal axis of the body portion, and comprises a channel, the inner surface of which is preferably coated or painted with a dark coloured material. The alignment tool may optionally further comprise one or more pin portions which are integrally connected to the bottom surface of the body portion at prescribed points relative to the longitudinal axis defined thereby.

There is a need for improved golf ball markers.

SUMMARY OF THE INVENTION

In one aspect, the present invention provides a golf ball alignment tool for assisting a golfer in visually aligning a golf ball with a golf hole, the tool comprising a support base and an alignment indicator, wherein the alignment indicator is mounted on the support base and moveable relative thereto to allow adjustment of the alignment indicator without movement of the support base. The benefit of the alignment indicator being movable relative to a support base is that a golfer can visually align their next shot by aiming the alignment indicator at the golf hole. It is customary for a golfer to remove their golf ball from a golf green until it is their turn. The golf ball alignment tool of the present invention may function as a marker of the removed golf balls position as the support base can remain in situ. The alignment indicator which is movable relative to the support base allows the golfer to visually align their next shot either when the golf ball is present or equally when the golf ball is not present.

The golf ball alignment tool of the present invention may comprise a base concave end dimensioned to receive a golf ball, for example the support base may comprise a base concave end dimensioned to receive a golf ball. The base concave end which is concave and dimensioned to receive a golf ball allows the golf ball alignment tool to be placed substantially abutting a golf ball.

In a golf ball alignment tool of the present invention the alignment indicator may comprise an alignment concave end wherein the alignment concave end is substantially parallel to the base concave end. The alignment indicator comprising an alignment concave end which is substantially parallel to the base concave end provides a guide to guide the alignment indicator when it is moving relative to the support base. The alignment indicator comprising an alignment concave end which is substantially parallel to the base concave end provides for the alignment indicator to be substantially adjacent to a golf ball while maintaining a gap such that the alignment indicator can be moved without disturbing the golf ball.

The golf ball alignment tool of the present invention wherein the alignment indicator may comprise an alignment distal end which is distal to the alignment concave end, and an alignment guide extending from the alignment concave end to the alignment distal end, optionally wherein the alignment guide is positioned along the centre of the alignment indicator. An alignment guide which extends along the centre of the alignment indicator provides a good visual aid to the golfer when aligning their golf shot.

In a golf ball alignment tool of the present invention the alignment concave end may be movable through a smaller distance than the alignment distal end. The alignment concave end moving through a smaller distance than the alignment distal end may be achieved by having the alignment indicator pivot on the support base, for example about a concave end of the support base. The support base may have a concave end and the alignment indicator may be mounted thereon to pivot so that the alignment indicator moves about the concave end. Where both the support base and the alignment indicator each have a concave end desirably the concave ends are in a nested configuration. Suitably during movement of the alignment indicator relative to the support base the concave ends remain nested through the range of movement of the alignment indicator.

Desirably the alignment indicator may comprise one or more secondary aiming lines. The secondary aiming lines of the alignment indicator may be used to determine the positioning of the golf ball when the golf ball is abutting the golf ball alignment tool.

The secondary aiming lines may be parallel or perpendicular or a combination of lines each of which may be parallel or perpendicular to the alignment guide. The secondary aiming lines being parallel or perpendicular or a combination thereof may be used to determine the position of the golf ball when the golf ball is abutting the golf ball alignment tool.

The present invention also relates to a golf ball stencil for marking a golf ball.

The golf ball stencil for marking a golf ball may have a spherical enclosure defined by at least one wall and dimensioned to resiliently open and close to receive and hold a golf ball within the enclosure.

Desirably in the golf ball stencil for marking a golf ball of the present invention the wall of the spherical enclosure forms a stencil for applying markings to a golf ball held within the spherical enclosure. Golfers may have a preferred brand or type of golf ball. The golf ball stencil which comprises a stencil allows the golfer to apply markings to their preferred type golf ball or to any number of golf balls as the golfer requires.

Desirably the golf ball stencil for marking a golf ball of the present invention may be used to apply markings to the golf ball which comprise a main ball alignment line which extends partially along a great circle of the golf ball. A golf ball is a sphere. Within the present invention the expression great circle is used in relation to a sphere and is the largest circle which can be drawn around the surface of a sphere. A great circle is any circle described on the surface of a sphere by a plane which passes through the centre of the sphere. A great circle is a circle on the surface of a sphere which lies in a plane passing through the sphere's centre. A great circle of a golf ball is the largest circle which can be drawn around the surface of golf ball. A great circle of a golf ball is any circle described on the surface of a golf ball by a plane which passes through the centre of the golf ball. A great circle of a golf ball is a circle on the surface of a golf ball which lies in a plane passing through the sphere's centre. There may be any number of great circles of a golf ball. The main ball alignment line which extends partially along a great circle of the golf ball means that the main ball alignment line is correctly positioned on the golf ball no matter which great circle of the golf ball the main alignment line the extends partially along.

The golf ball stencil for marking a golf ball of the present invention may be used to apply markings to the golf ball wherein the markings may comprise one or more secondary ball alignment lines which extend partially along a small circle of the golf ball. A golf ball is a sphere. A small circle is a spherical section that does not contain a diameter of the sphere. A small circle of a golf ball is a spherical section that does not contain the diameter of the golf ball. The positioning of one or more secondary ball alignment lines which extend partially along a small circle of the golf ball allows the golf ball to be marked with secondary ball alignment lines which are separate to the main ball alignment line.

Optionally the secondary ball alignment lines comprise one or more lines any one of which, and optionally each of which, is either parallel to or perpendicular to the main alignment line.

In one aspect the invention comprises a kit comprising the golf ball alignment tool as described herein and the golf ball stencil as described herein.

In the kit of the present invention suitably the alignment guide and the main ball alignment line are alignable to form a main alignment indicator. The alignment guide may be aimed at the golf hole. Once the alignment guide is aimed at the golf hole the golf ball may be positioned such that the alignment guide and the main ball alignment line are aligned to form a main alignment indicator. As the golf ball alignment tool must be removed prior to taking the golf shot this allows the golfer to not require the golf ball alignment tool but to rely on the main ball alignment line, which has already been positioned using the golf ball alignment tool, for indicating the required aiming line to the golf hole.

Desirably one or more aiming lines may be alignable with the one or more secondary ball alignment lines to form secondary alignment indicators. The main ball alignment indicator can be used to position the golf ball such that the alignment guide and the main ball alignment line are substantially aligned. However as the golfer is aligning a three dimensional spherical golf ball with a two dimensional alignment indicator the alignment of the main alignment indicator may appear to be correctly formed when it may be slightly askew from the positioning of the alignment guide. The alignment of the one or more aiming lines with the one or more secondary ball alignment lines to form secondary alignment indicators allows the golfer to make corrections to the positioning of the golf ball and confirm that the main alignment indicator is correctly formed.

The present invention also provides a method for aligning a golf ball for assisting a golfer in visually aligning the golf ball with a golf hole comprising:

positioning a golf ball alignment tool so that the golf ball alignment tool abuts the golf ball wherein the golf ball alignment tool comprises a support base and an alignment indicator wherein the alignment indicator is mounted on the support base, and moving the alignment indicator relative to the support base without moving the support base. The method of positioning a golf ball alignment tool such that it abuts a golf ball and wherein the alignment indicator is movable while support base does not move allow the golfer to use the golf ball alignment tool to mark the position of the golf ball by means of a support base which does not need to be moved while concurrently allowing for visual alignment of the golf ball with the golf hole by moving the alignment indicator.

In a method of the present invention the golf ball alignment tool may abut the golf ball at, for example a base concave end of the support base which is dimensioned to receive a golf ball. The method of aligning wherein the base concave end of the support base is dimensioned to receive the golf ball allows the base concave end to more intimately abut the golf ball. In such a position the golf ball is nested within the concave end.

In a method of the present invention the alignment indicator may comprise an alignment concave end which is substantially parallel to the base concave end. The alignment concave end which is substantially parallel to the base concave end allows the alignment indicator to move in a substantially pivoting movement about the support base while the support base does not move. The alignment indicator comprising an alignment concave end which is substantially parallel to the base concave end provides a guide to guide the alignment indicator when it is moving relative to the support base. The alignment indicator comprising an alignment concave end which is substantially parallel to the base concave end provides for the alignment indicator to be substantially adjacent to a golf ball while maintaining a gap such that the alignment indicator can be moved without disturbing the golf ball.

In a method of the invention the alignment indicator may have an alignment distal end, distal to the concave alignment end, and an alignment guide extending from the alignment concave end to the alignment distal end, wherein the alignment guide is positioned along the centre of the alignment indicator, and moving the alignment indicator such that the alignment guide visually aligns with the golf hole. The method of aligning a golf ball wherein an alignment guide extends from the alignment concave end to the alignment distal end of the alignment indicator provides the golfer with an alignment guide which can be used to precisely aim the golfer's next golf shot. The alignment guide which extends along the centre of the alignment indicator provides a good visual aid to the golfer when aligning their golf shot.

In the method of the invention the alignment concave end may be movable through a smaller distance than the alignment distal end. The alignment concave end moving through a smaller distance than the alignment distal end may be achieved by having the alignment indicator pivot on the support base, for example about a concave end of the support base. The support base may have a concave end and the alignment indicator may be mounted thereon to pivot so that the alignment indicator moves about the concave end. Where both the support base and the alignment indicator each have a concave end desirably the concave ends are in a nested configuration. Suitably during movement of the alignment indicator relative to the support base the concave ends remain nested through the range of movement of the alignment indicator.

Desirably in the method of the invention the alignment indicator may comprise one or more secondary aiming lines. The secondary aiming lines of the alignment indicator may be used to determine the positioning of the golf ball when the golf ball is abutting the golf ball alignment tool.

The secondary aiming lines may be parallel or perpendicular or a combination of lines each of which may be parallel or perpendicular to the alignment guide. The secondary aiming lines being parallel or perpendicular or a combination thereof may be used to determine the position of the golf ball when the golf ball is abutting the golf ball alignment tool.

In a method of aligning a golf ball of the present invention the golf ball may be marked using a golf ball stencil.

In a method of the present invention the golf ball may be marked with a main ball alignment line which extends partially along a great circle of the golf ball. The benefit of the golf ball being marked with a main ball alignment line which extends partially along a great circle of the golf ball is this allows any golf ball to be marked for use in the method of the present invention. As there are alternative golf balls on the market the positioning of the main ball alignment line which extends partially along the great circle of the golf ball means that there is a marking the main ball alignment line which can be performed on any golf ball as all golf balls will have a great circle.

The golf ball may be marked with one or more secondary alignment lines which extend partially along a small circle of the golf ball. A golf ball is a sphere. A small circle is a spherical section that does not contain a diameter of the sphere. A small circle of a golf ball is a spherical section that does not contain the diameter of the golf ball. The positioning of one or more secondary ball alignment lines which extend partially along a small circle of the golf ball allows the golf ball to be marked with secondary ball alignment lines which are separate to the main ball alignment line. The golf ball being marked with one or more secondary alignment lines which extend partially along a small circle of the golf ball allows the golf ball to be additionally marked to aid in the method of aligning the golf ball.

The secondary ball alignment lines may comprise one or more lines which are parallel to the main ball alignment line. The secondary ball alignment lines may comprise one or more lines which are perpendicular to the main ball alignment line. The secondary ball alignment lines may comprise a combination of lines which are perpendicular to the main ball alignment line and lines which are parallel to the main ball alignment line.

The method of the present invention may comprise positioning the golf ball such that the main ball alignment line on the golf ball aligns with the alignment guide on the alignment indicator. The alignment guide may be aimed at the golf hole. Once the alignment guide is aimed at the golf hole the golf ball may be positioned such that the alignment guide and the main ball alignment line are aligned to form a main alignment indicator. As the golf ball alignment tool must be removed prior to taking the golf shot this allows the golfer to not require the golf ball alignment tool but to rely on the main ball alignment line, which has already been positioned using the golf ball alignment tool, for indicating the required aiming line to the golf hole. Positioning the golf ball such that the main ball alignment line on the golf ball aligns with the alignment guide on the alignment indicator allows the alignment guide to be used in a method of aligning the ball where the ball does not need to be present or if present does not need to be moved until after the alignment guide has been aligned. The method may comprise aligning the alignment guide and subsequently positioning the golf ball such that the main ball alignment line substantially aligns with the alignment guide.

The method of the invention may comprise positioning the golf ball such that the one or more secondary ball alignment lines on the golf ball are aligned with the one or more secondary aiming lines on the alignment indicator. The main ball alignment indicator can be used to position the golf ball such that the alignment guide and the main ball alignment line are substantially aligned. However as the golfer is aligning a three dimensional spherical golf ball with a two dimensional alignment indicator the alignment of the main alignment indicator may appear to be correctly formed when it may be slightly askew from the positioning of the alignment guide. The alignment of the one or more aiming lines with the one or more secondary ball alignment lines to form secondary alignment indicators allows the golfer to make corrections to the positioning of the golf ball and confirm that the main alignment indicator is correctly formed. Positioning the golf ball such that the one or more secondary ball alignment line on the golf ball are aligned with the one or more secondary aiming lines on the alignment indicator allows the golfer to adjust the position of the golf ball to correct for any deviation in alignment which may occur between the main ball alignment line and the alignment guide.

In another aspect the invention relates to the use of the golf ball alignment tool and/or the golf ball stencil as described above in a method of aligning a golf ball as described above.

BRIEF DESCRIPTION OF THE DRAWINGS

Embodiments of the invention will be described, by way of example only, with reference to the accompanying drawings in which:

FIG. 3*a* shows a top view of the golf ball alignment tool of FIG. 1 while

FIG. 4*a* shows a front view while

FIG. 5*a* shows a marked golf ball for use with a golf ball alignment tool and how a removable disc can be used as a positional marker for a golf ball while

FIG. 6*a* shows visual alignment of a golf ball with the golf ball alignment tool from an end view while

FIG. 7*a* shows a perspective view of a golf ball misaligned with the golf ball alignment tool while

DETAILED DESCRIPTION OF THE DRAWINGS

A golf ball alignment tool within the present invention is described below with reference to the figures.

Figure 1:
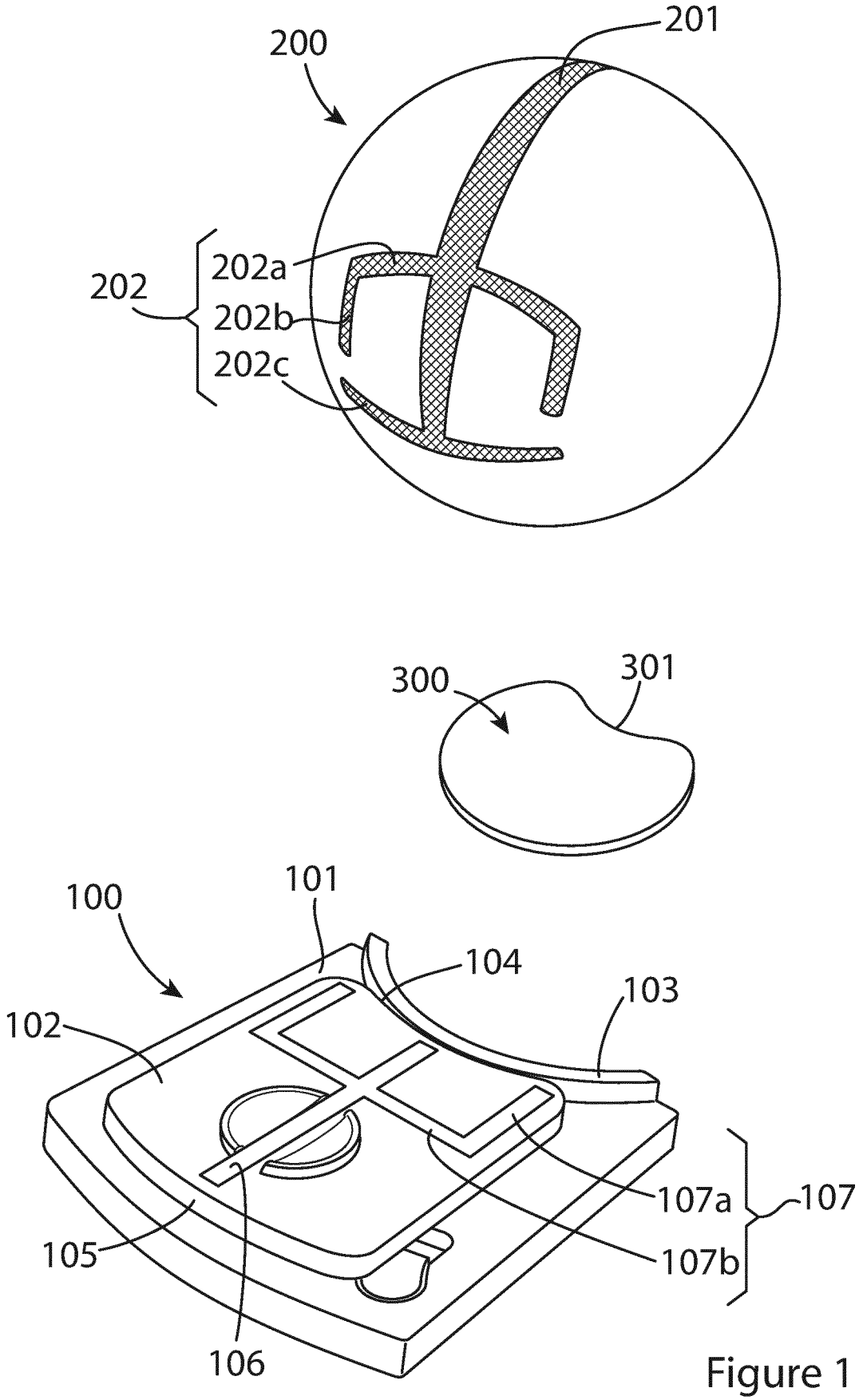
FIG. 1 shows a perspective view of the golf ball alignment tool together with a golf ball which is marked using the golf ball stencil of the invention.

A golf ball alignment tool 100 and a golf ball 200 are shown in FIG. 1.

The golf ball 200 is shown comprises markings 201, 202 which have been applied to the golf ball 200. The markings shown on the golf ball 200 in FIG. 1 comprise a main ball alignment line 201. The main ball alignment line 201 extends partially along a great circle 401 of the golf ball 200. A great circle 401 on the surface of a sphere 400 is a circle which lies in a plane passing through the sphere's centre 402, that is, a great circle 401 is the largest circle which can be drawn on the surface of any given sphere, for example sphere 400 or golf ball 200. As the skilled person will appreciate a sphere 400 such as a golf ball 200 comprises any number of great circles 401. The main ball alignment line 201 of the present invention may be marked along any great circle 401 of the golf ball 200.

In FIG. 1 secondary alignment lines 202 are also shown. The golf ball 200 may comprise one or more secondary ball alignment lines 202 which extend partially along a small circle 403 of the golf ball 200. A small circle 403 of a sphere 400 is a circle on the surface of a sphere 400 whose plane does not pass through the sphere's centre 402. A small circle 403 of a sphere 400 cannot be a great circle 401 of a sphere and vice versa. A sphere 400 such as a golf ball 200 may comprise any number of small circles 403. The secondary ball alignment lines 202 may be marked along any small circle 403 of the golf ball 200. Preferably the secondary ball alignment lines 202 may comprise lines which are parallel 202*b* to the main alignment line 201. Preferably the secondary ball alignment lines 202 may comprise lines which perpendicular 202*a*, 202*c* to the main ball alignment line 201. The secondary ball alignment lines 202 may comprise a combination of lines, some of which may be parallel 202*b* and some of which may be perpendicular 202*a*, 202*c* to the main alignment line 201.

The embodiment of the golf ball alignment tool 100 is shown in FIG. 1 and comprises a support base 101 and an alignment indicator 102. The alignment indicator 102 is mounted on the support base 101. The alignment indicator 102 is moveable relative to the support base 101 as shown in the range of movement indicated by the arrow 115 of FIGS. 8 and 9. This allows adjustment of the alignment indicator 102 without movement of the support base 101.

The support base 101 of the golf ball alignment tool 100 may have a base concave end 103 dimensioned to receive a golf ball 200. The base concave end 103 may allow the golf ball alignment tool 100 to be positioned such that the golf ball alignment tool 100 abuts the golf ball 200. The golf ball is thus nested (partially) within the concave end.

The alignment indicator 102 of the golf ball alignment tool 100 may also comprise an alignment concave end 104. The alignment concave end 104 may run substantially parallel to the base concave end 103. The parallel configuration of the alignment concave end 104 and the base concave end 103 may facilitate the alignment indicator 102 to move relative to the support base 101 without movement of the support base 101.

The alignment indicator 102 of the golf ball alignment tool 100 as shown in FIG. 1 also comprises an alignment distal end 105 which is distal to the alignment concave end 104. An alignment guide 106 extend from the alignment concave end 104 to the alignment distal end 105. The alignment guide 106 is positioned along the centre of the alignment indicator 102.

The alignment indicator 102 of the golf ball alignment tool 100 is movable relative to the support base 100. The alignment concave end 104 is movable through a smaller distance than the alignment distal end 105.

The alignment indicator 102 of the golf ball alignment tool 100 may also comprise one or more secondary aiming lines 107. The one or more secondary aiming lines 107 may be parallel 107*a* or perpendicular 107*b* or a combination thereof to the alignment guide 106.

The golf ball alignment tool 100 may also comprise a removable disc 300. The removable disc 300 may be used as a traditional golf ball position marker when the golfer does not wish to use the golf ball alignment tool 100 as a place marker for the ball when the ball is removed to allow another player to take a shot.

Figure 2A:
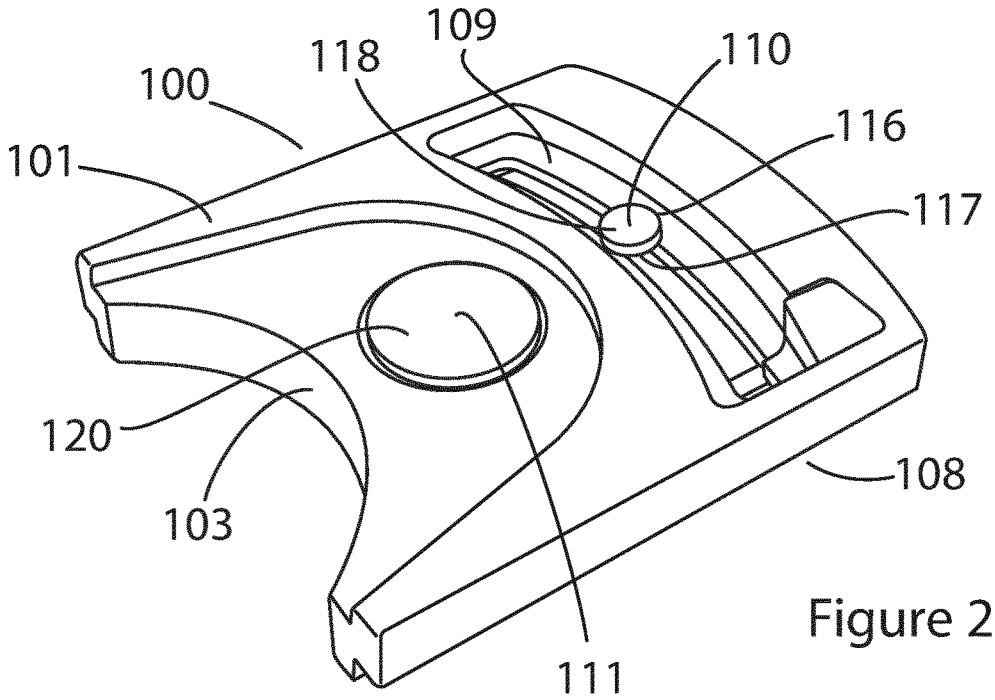
FIG. 2*a* shows a bottom perspective view and FIG. 2*b* shows a bottom view of the golf ball alignment tool of FIG. 1 with a removable disc shown in dashed outline.
Figure 2B:
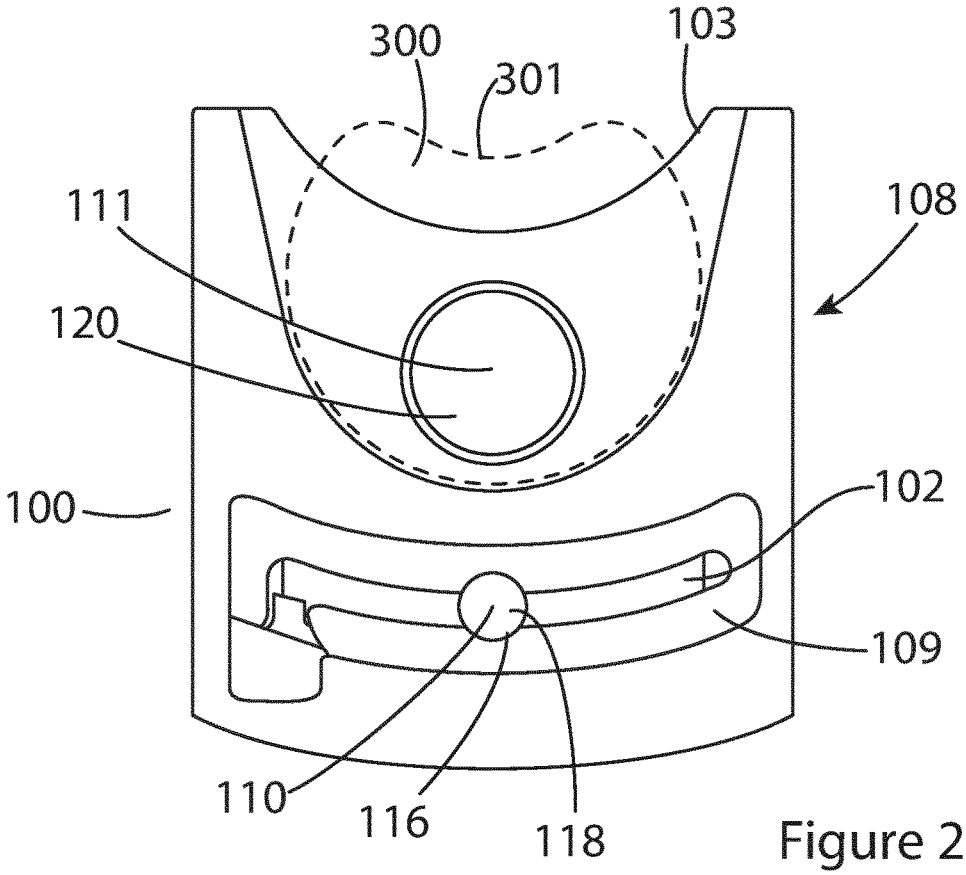

FIGS. 2*a* and 2*b* shows the underside 108 of the golf ball alignment tool 100. The underside 108 is the side which will be placed facing the ground of the golf green when the golf alignment tool 100 is in use to align a golf shot.

The underside 108 of the golf alignment tool 100 as shown in FIGS. 2*a* and 2*b* has an arcuate slot 109 which is defined in the support base 101. The arcuate slot 109 is an aperture which goes the whole way through the support base 101. The arc of the arcuate slot 109 is an arc of a circle which has substantially the same centre as a circle which the base concave end 103 is an arc of.

The alignment indicator 102 comprises a retaining means 110. The retaining means 110 projects from the opposite side of the alignment indicator 102 to the side which comprises the alignment guide 106. The retaining means 110 is shown in FIGS. 2*a* and 2*b* in the form of a pin 116 projecting through the arcuate slot 109 of the support base 101. The retaining means 110 in the form of a pin 116 functions to moveably mount the alignment indicator 102 to the support base 101.

The retaining means 110 is shown in FIGS. 2*a* and 2*b* as pin 116 shaped wherein the body 117 of the retaining means 110 fits through the arcuate slot 109 and the head 118 of the retaining means 110 is wider than the arcuate slot 109. This configuration of retaining means 110 allows the retaining means 110 to move freely along the arcuate slot 109 while maintaining the retaining means 110 within the arcuate slot 109. This means that the alignment indicator 102 to which the retaining means 110 projects is moveably mounted to the support base 101 through the arcuate slot 109. The skilled person will appreciate that there are other configurations by which the alignment indicator 102 may be moveably mounted to the support base 101 other than the embodiment shown in FIGS. 2*a* and 2*b*.

The underside 108 may also comprise an attachment means 111 for removeably attaching removable disc 300 to the golf ball alignment tool 100. The removable disc 300 may be made from plastic, metal or any other suitable material. In the embodiment shown in FIG. 2*b* the removable disc 300 is made from a ferrous material and the attachment means 111 is a magnet 120 capable of magnetically removeably attaching the removable disc 300 to the attachment means 111. The skilled person will appreciate that the attachment means 111 may be any suitable means such as a pressure sensitive adhesive which allow the removable disc 300 to be removeably attached to the golf ball alignment tool 100.

Figure 3A:
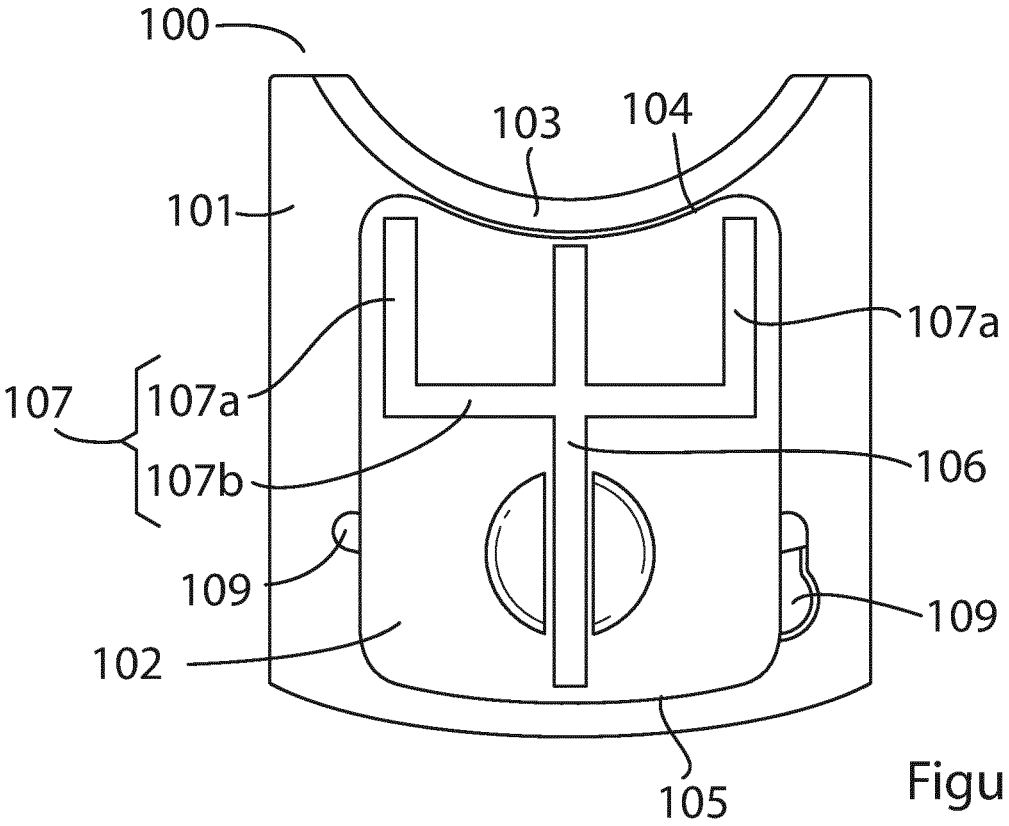
Figure 3B:
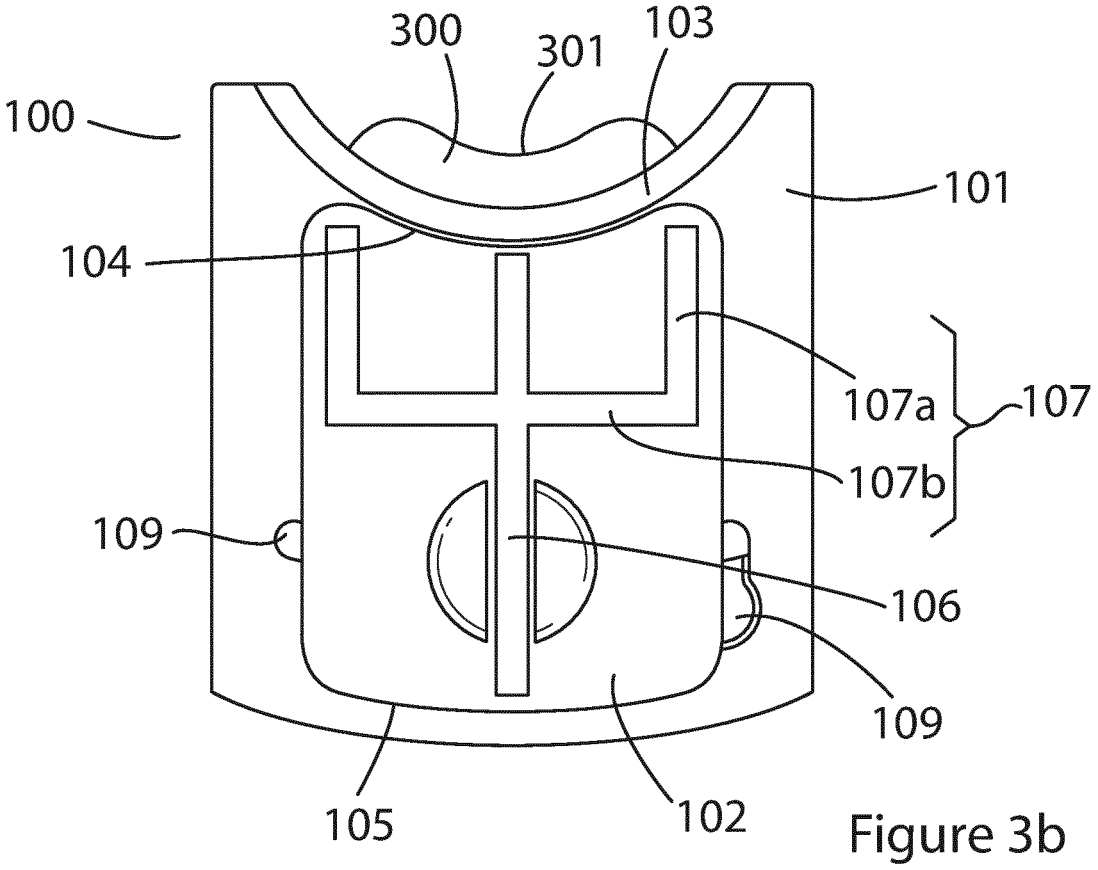
FIG. 3*b* shows the same view but with a removable disc in place.

FIGS. 3*a* and 3*b* shows a top down view of an embodiment of the golf ball alignment tool 100 of the present invention.

Figure 4A:
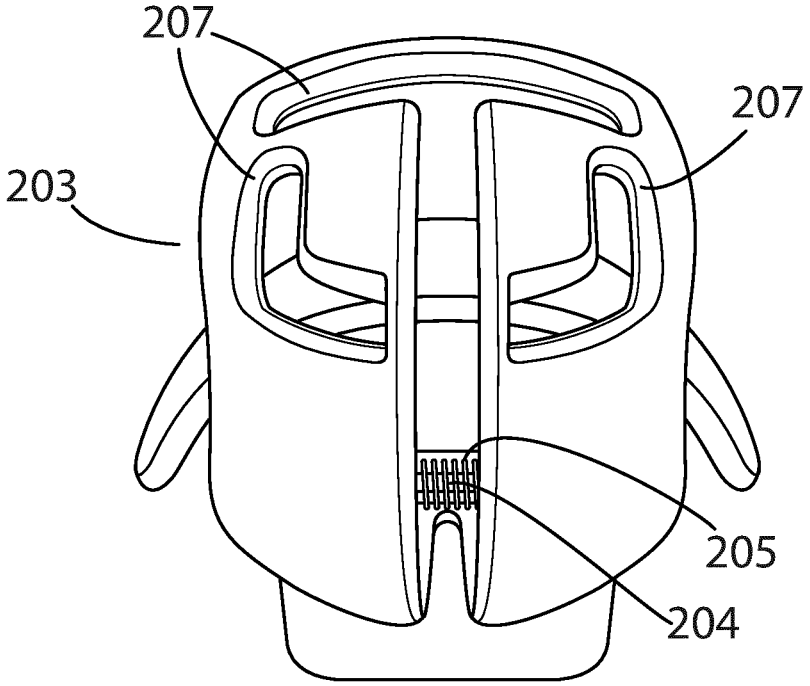
Figure 4B:
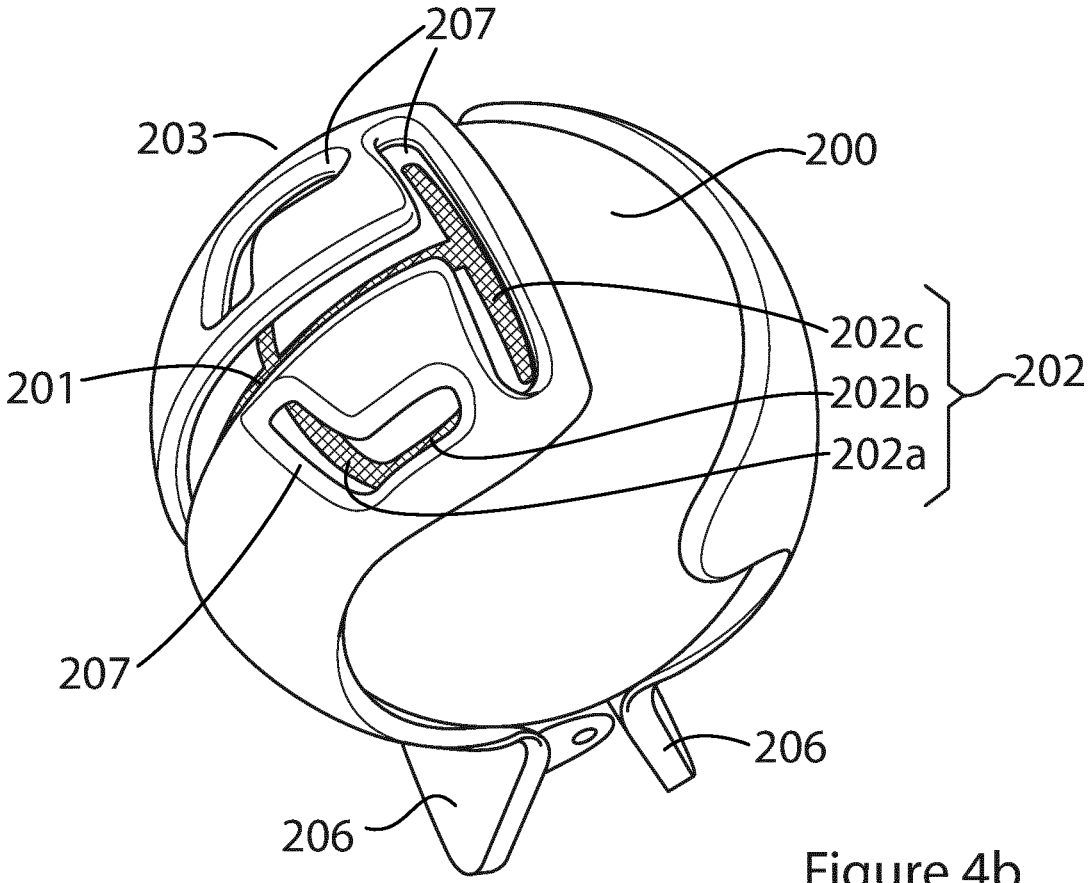
FIG. 4*b* shows a perspective view of the golf ball alignment tool of FIG. 1.

A golf ball stencil 203 is shown in FIGS. 4*a* and 4*b*. The golf ball stencil 203 may be used to mark a golf ball 200.

The golf ball stencil 203 may comprise a spherical enclosure defined by at least one wall and dimensioned to resiliently open and close to receive and hold a golf ball 200 within the enclosure.

The golf ball stencil 203 may resiliently open and close by means of a hinge 204. The hinge 204 may be is biased toward a closed position in which closed position the golf ball stencil 203 holds a golf ball 200 within the spherical enclosure. The hinge 204 may be biased to a closed position by a biasing means 205. The biasing means 205 may comprise a spring as shown in FIG. 4*a* or any other suitable means. The closing bias of the biasing means 205 may be overcome by applying pressure on the grips 206. Pressure on the grips 206 overcomes the biasing means 205 and causes the spherical enclosure of the golf ball stencil 203 to open sufficiently to allow the golfer to insert or remove a golf ball 200 from the spherical enclosure of the golf ball stencil 203.

The golf ball stencil 203 may form a stencil 207. The stencil 207 may be used by the golfer to apply markings to a golf ball 200 while held within the spherical enclosure of the golf ball alignment tool 203. A golf ball 200 may be stencilled with markings by applying a marking material such as ink or paint through the stencil 207 to create markings. The marking material is preferably indelible.

The golf ball stencil 203 may be used to mark the golf ball 200 with a main alignment line 201 by applying a marking material through the stencil 207 and onto the golf ball 200. The golf ball stencil 203 comprises a stencil 207 which may be used to position the markings of a golf ball 200 such that a main alignment line 201 extends partially along a great circle 401 of the golf ball 200.

The golf ball stencil 203 may be used to mark the golf ball 200 with secondary ball alignment lines 202 by applying a marking material through the stencil 207 and onto the golf ball 200. The golf golf ball stencil 203 may be used to mark a golf ball 200 with secondary ball alignment lines 202 which extend partially along a small circle of a golf ball 200. The secondary ball alignment lines 203 which may be marked onto a golf ball 200 by applying a marking material through the stencil 207 may comprise lines which are parallel 202*b* or perpendicular 202*a*, 202*c* or both to the main alignment line 201.

Figure 5A:
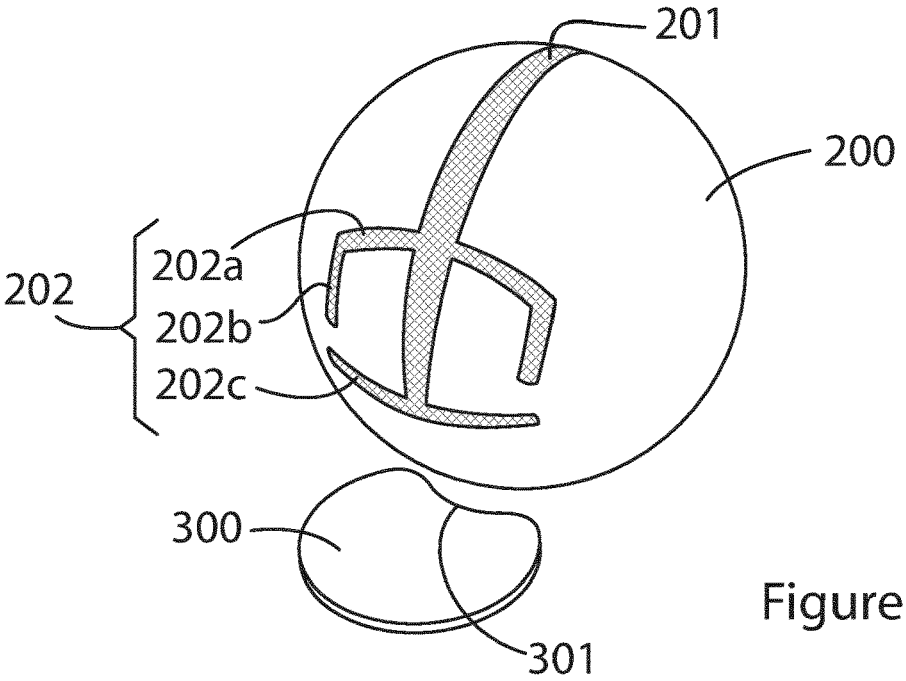

The removable disc 300 may have be shaped to substantially receive a golf ball 200 by means of a recess 301, the recess being dimensioned to receive a golf ball 200. The removable disc 300 may be used as a marker for the golf ball 200 as shown in FIG. 5*a*.

Figure 5B:
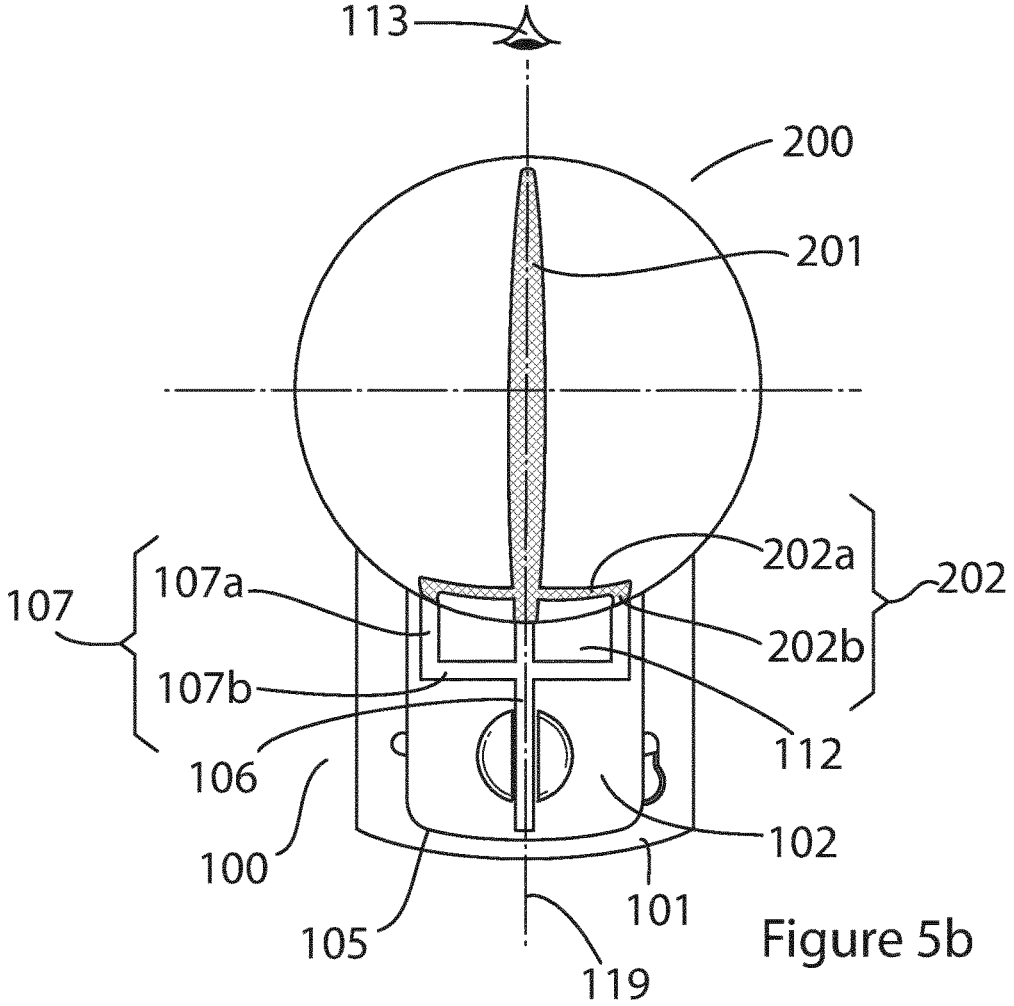
FIG. 5*b* shows how the marked golf ball and the golf ball alignment tool are used together to align for a shot.

FIG. 5*b* shows a schematic of a method for aligning a golf ball 200 for assisting a golfer in visually aligning the golf ball 200 with a golf hole. The golf ball alignment tool 100 has been positioned by the golfer so that the golf ball alignment tool 100 abuts the golf ball 200.

The alignment guide 106 and the main ball alignment line 201 are alignable to form a main alignment indicator and are shown aligned in FIG. 5*b*. The secondary aiming lines 107 are alignable with the secondary ball alignment lines 202 to form secondary alignment indicators and are shown aligned in FIG. 5*b*.

For correct alignment of a golf ball 200 for assisting a golfer in visually aligning the golf ball 200 with a golf hole the method of the present invention does not require the golf ball 200 to remain abutting the golf ball alignment tool 100. Once the golf ball alignment tool 100 has been positioned abutting the golf ball 200 the golf ball alignment tool 100 acts as a golf ball marker for marking the position of the golf ball 200 on the green. The golf ball 200 may then be removed from the golf green. The golf ball alignment tool 100 comprises a support base 101 which may remain in a fixed position on the golf green to mark the position of the golf ball 200 on the golf green. The alignment indicator 102 is mounted on the support base 101 and may be moved relative to the support base 101 without moving the support base 101. This allows the golfer to visually align their next golf shot by positioning the alignment indicator 102 without moving the support base 101. The alignment guide 106 which extends from the alignment concave end 104 to the alignment distal end is positioned along a line 119 through the centre of the alignment indicator 102. The golfer may align the alignment guide 106 to the alignment of their next golf shot without the golf ball 200 being present on the golf green. This allows the golfer to align their next shot while other players are taking their golf shots and allows the golfer more time to align their shot. Once the golfer is confident that the alignment guide 106 of the alignment indicator 102 is aimed in the correct alignment and it is the golfers turn to play, the golfer may return the golf ball 200 such that it is abutting the golf ball alignment tool 100. The golfer will position the golf ball 200 such that the main ball alignment line 201 now aligns with the alignment guide 106 to form a main alignment indicator. The golfer can further position the golf ball 200 to align the parallel secondary ball alignment lines 202*b* with the parallel secondary aiming lines 107*a* such that the parallel secondary ball alignment lines 202*b* are aligned with parallel aiming lines 107*a* form secondary alignment indicators. The golfer can further position the golf ball 200 such that the first perpendicular secondary ball alignment line 202*a* is parallel to the perpendicular secondary aiming line 107*b*. The golfer may position the golf ball 200 such that the shape formed between the main alignment indicator, the secondary alignment indicator, the first perpendicular secondary ball alignment line and the perpendicular secondary aiming line forms a shape such as a rectangle shown as an alignment rectangle 112. The golfer can now remove the golf ball alignment tool 100 and strike the golf ball such that the golf ball travels along the path which the golfer has visually aligned between the golf ball 200 and the golf hole.

Figure 7A:
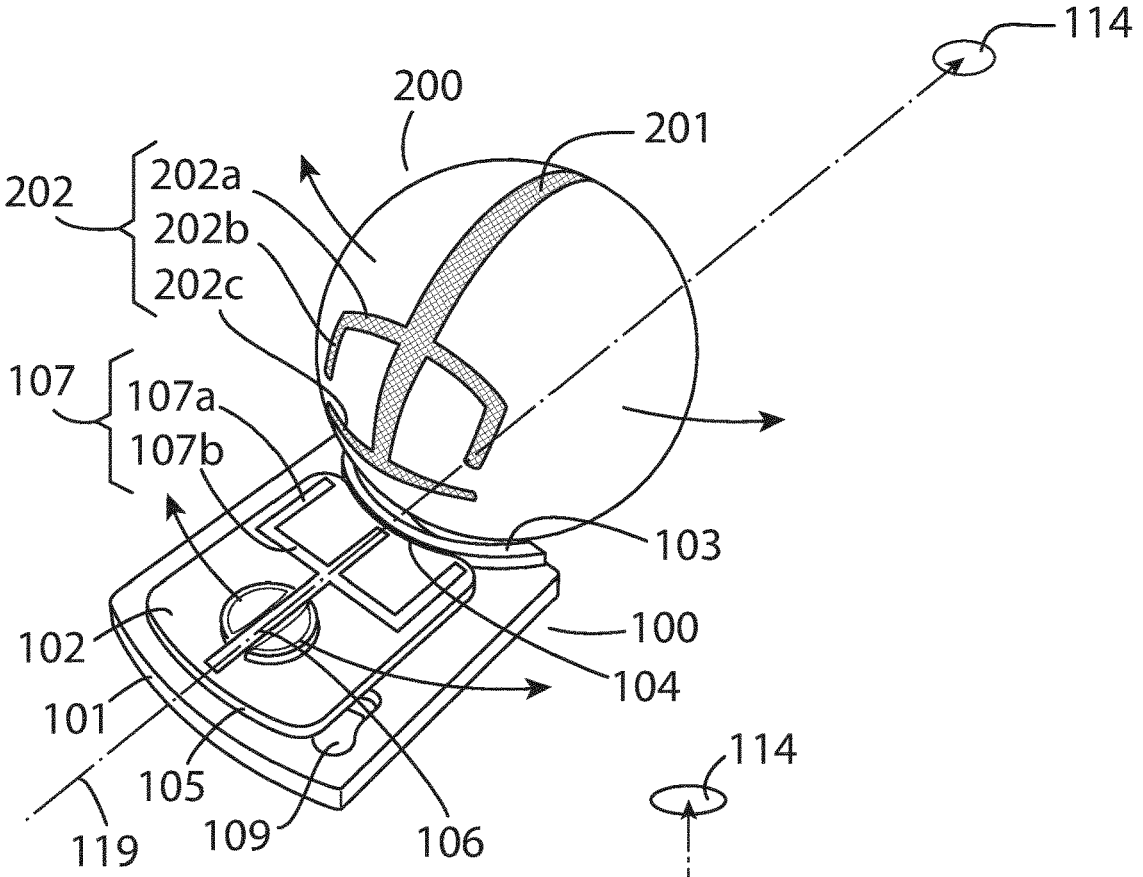
Figure 7B:
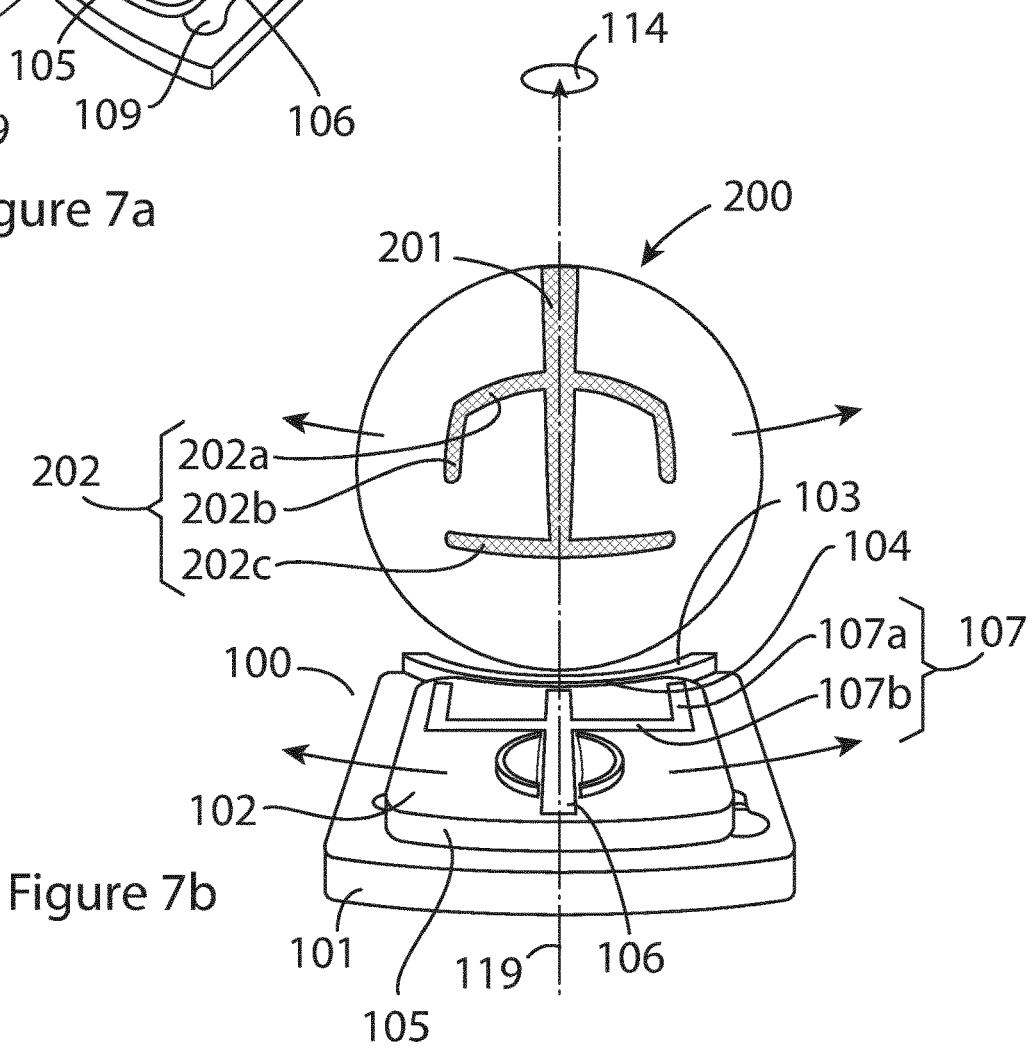
FIG. 7*b* shows a perspective view of a golf ball correctly aligned with the golf ball alignment tool.

In FIG. 7*a* the golf ball alignment tool 100 is shown wherein the support base 101 has been positioned abutting a golf ball 200. The alignment indicator 102 may be moved relative to allow adjustment of the alignment indicator 102 without movement of the support base 101. The alignment indicator 102 may be used to assist the golfer in visually aligned the golf ball 200 with a golf hole by moving the alignment indicator 102 to the left or to the right relative to the support base 101. The alignment concave end 104 is movable through a smaller distance than the alignment distal end 105. This allows the alignment indicator 102 to be aimed at the golf hole while also maintaining the alignability of the alignment guide 106 with the main ball alignment line 201 when a golf ball 200 is abutting the base concave end 103. As shown in FIG. 7*a* the main ball alignment line 201 may not initially be aligned with the alignment guide 106. The position of the golf ball 200 can then be adjusted such that the main ball alignment line 201 aligns with the alignment guide 106 such that a main alignment indicator is formed as shown in FIG. 7*b*.

Figure 8:
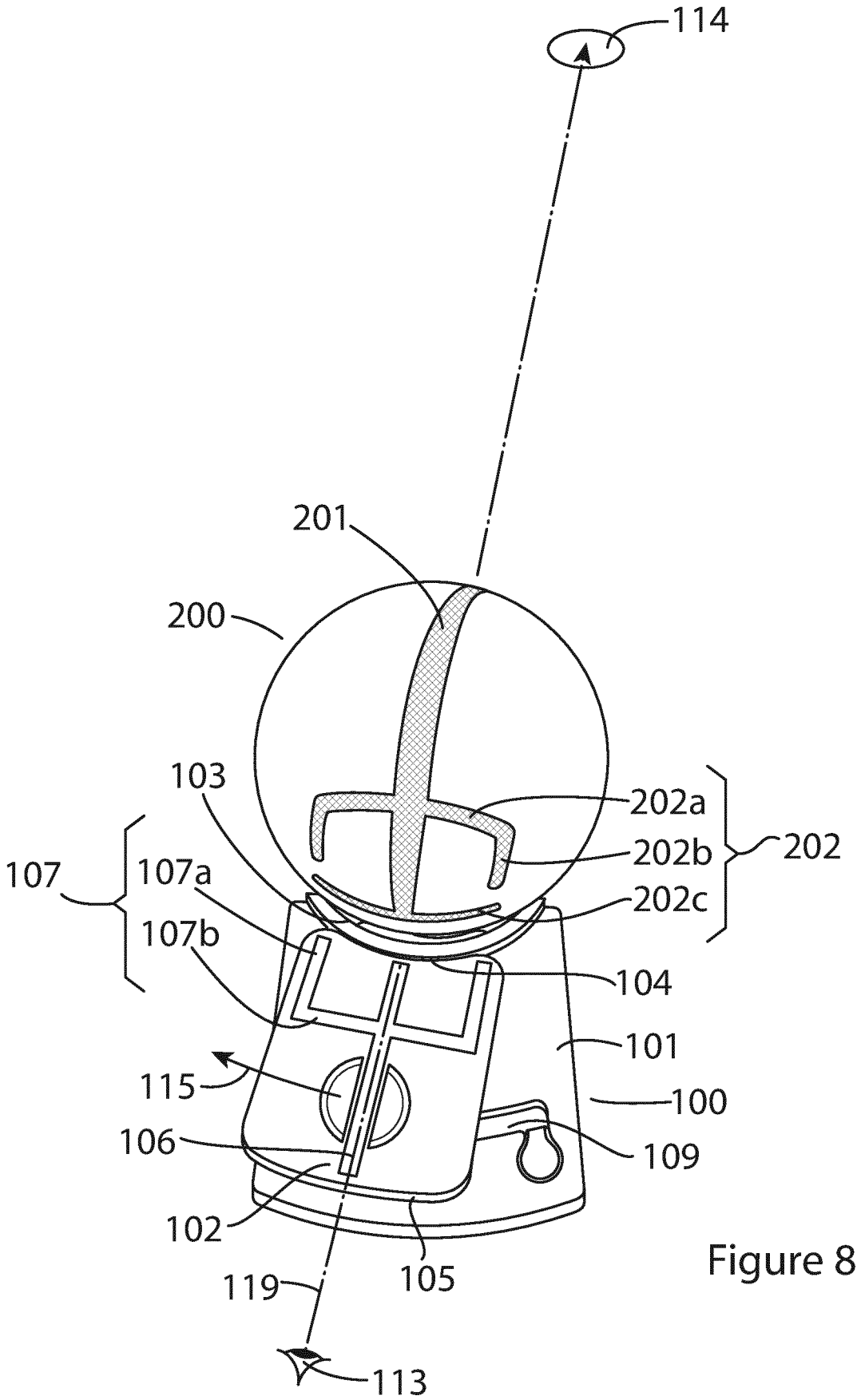
FIG. 8 shows a golf ball and golf ball alignment tool according to an embodiment of the invention wherein the golf ball alignment tool but not the golf ball is aligned to the golf hole.
Figure 9:
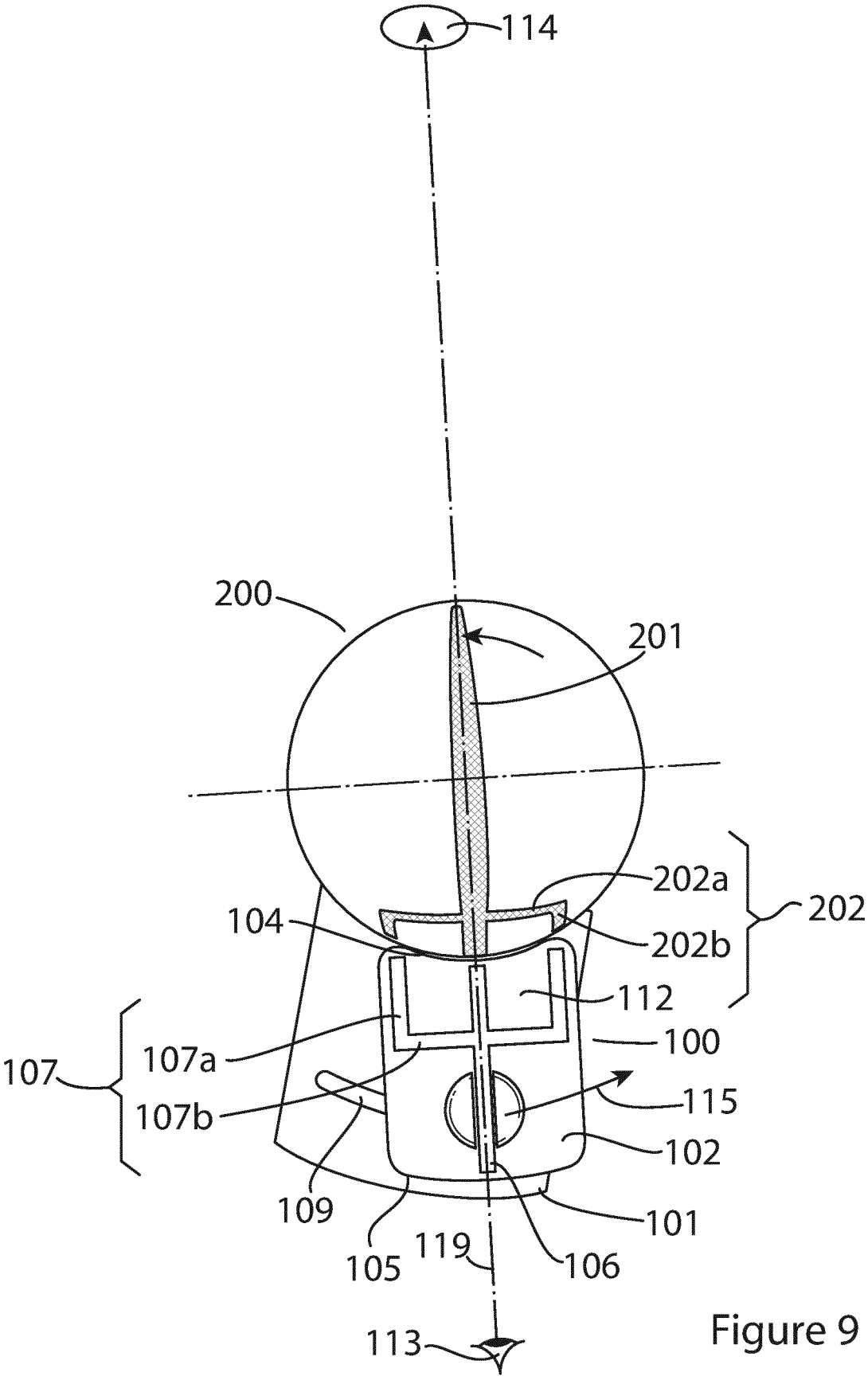
FIG. 9 shows a golf ball and golf ball alignment tool according to an embodiment of the invention wherein the golf ball alignment tool and the golf ball are both aligned to the golf hole.

FIG. 8 and FIG. 9 shows a top down view similar to the view which a golfer would see when preparing to take their golf shot but before they have removed the golf ball alignment tool 100. The golfer's viewpoint 113 shows them that they have aligned the golf ball alignment tool 100 such that they are satisfied that the alignment guide 106 of the alignment indicator 102 is positioned such that the alignment guide 106 is visually aligned with the golf hole 114. In FIG. 8 the golf ball 200 is positioned in such a way that the main ball alignment line 201 is not aligned with the alignment guide 106. If the golfer would strike the golf ball 200 along the path indicated by the main ball alignment line 201 the golf ball 200 would not move on the correct path to drop into the golf hole 114. In FIG. 9 the golfer has correctly aligned the golf shot by, from the golfer's viewpoint 113, aligning the alignment guide 106 of the golf ball alignment tool 100 with the golf hole 114. The golfer has adjusted the position of the golf ball 200 such that the main ball alignment line 201 aligns with the alignment guide 106. As shown in FIG. 9 the golfer's viewpoint is directly in line with the main alignment line formed by aligning the main ball alignment line 201 and the alignment guide 106. However the golfer's viewpoint may move when the golfer moves such that while it appears that the correct main alignment line has been formed the alignment may be slightly incorrect. The golfer can position the secondary ball alignment lines 202 such that they are aligned with the secondary alignment lines 107 for further visual confirmation that the golf ball 200 is correctly positioned such that when the golf ball 200 is struck that it travels in the correct direction to drop in the golf hole 114. From the golfer's viewpoint 114 the secondary ball alignment lines 202 and the secondary alignment lines 107 in combination with the main ball alignment line 201 and the alignment guide 106 form two alignment rectangles 112 thus further confirming the alignment of the golf ball 200 with the golf hole 114.

Figure 6A:
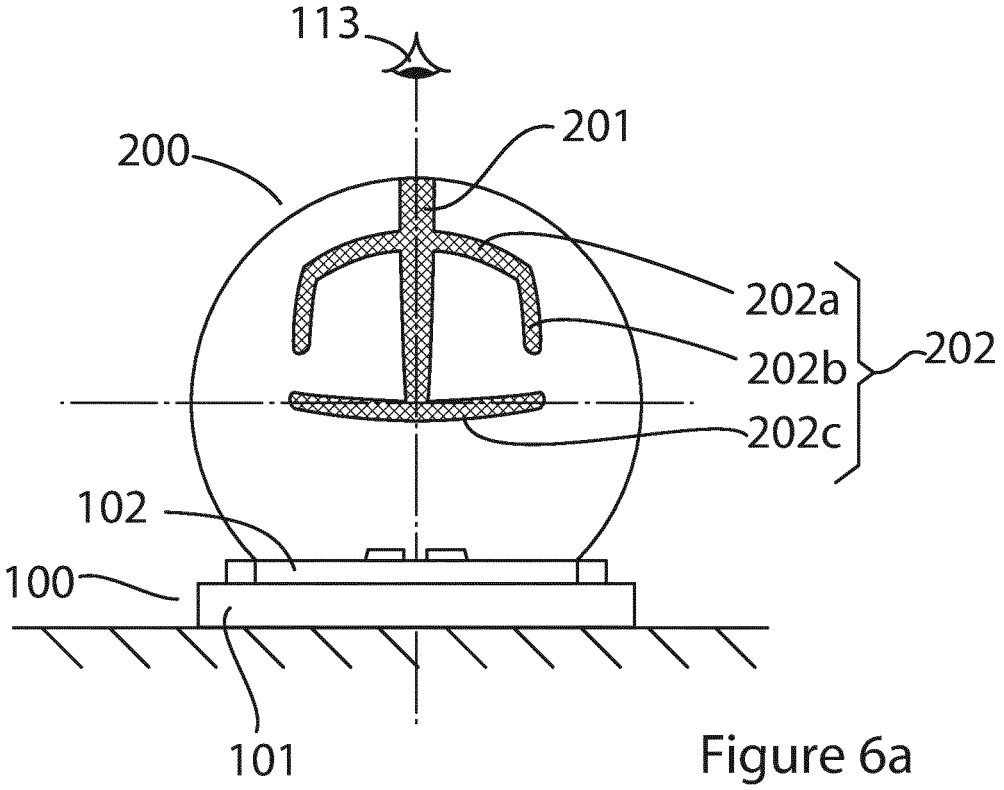
Figure 6B:
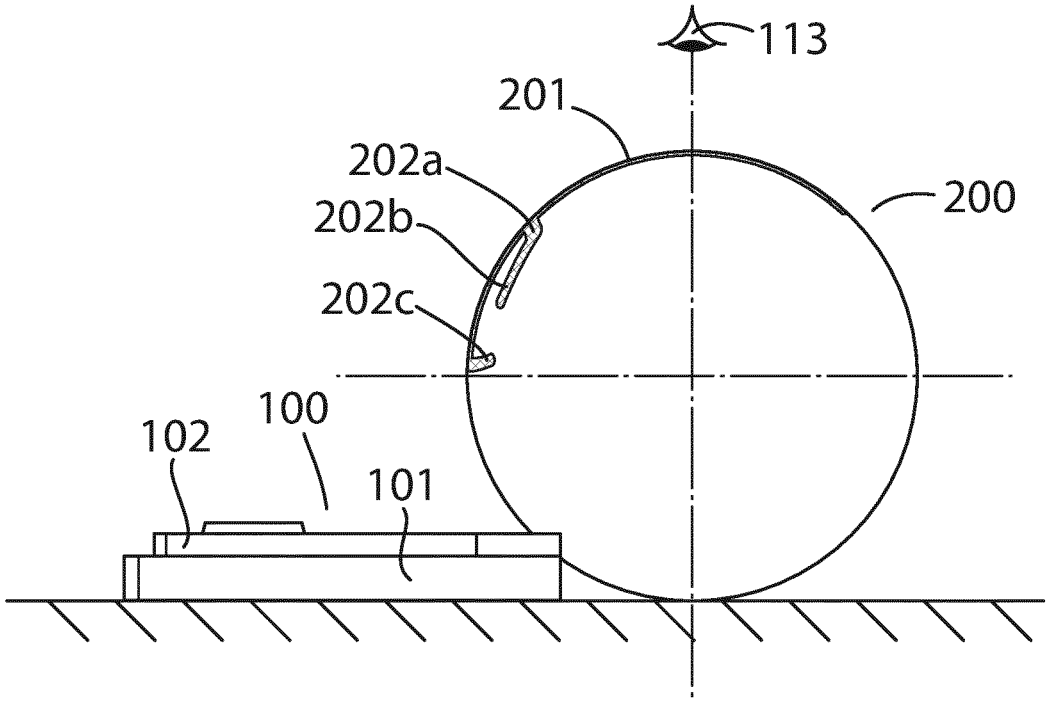
FIG. 6*b* shows visual alignment of a golf ball with the golf ball alignment tool from a side view.

The golfer when aiming the shot will have a viewpoint 113 which is substantially behind the golf ball alignment tool 100 as shown in FIGS. 8 and 9. This is beneficial for aiming the golf shot toward the golf hole 114. The golfers viewpoint 113 when taking the golf shot will no longer be behind the golf ball alignment tool 100 but instead will be above the golf ball alignment tool 100 and the golf ball 200, as shown in FIGS. 6*a* and 6*b* as the golfer must stand substantially directly above the golf ball 200 to perform a golf shot. The alignment of the main ball alignment line 201 with the alignment guide 106 and the secondary ball alignment lines 202 and the secondary aiming lines 107 to form an alignment rectangle 112 allows the golfer to change viewpoints 113 without affecting the aiming of the golf shot towards the golf hole 114 as the alignment rectangle 112 should appear rectangular once the golfers viewpoint 113 is above the golf ball 200, as shown in FIG. 5*b* and FIG. 9. If the alignment rectangle 112 is not formed, for example in FIG. 8, then the golf ball 200 is not correctly aligned with the golf ball alignment tool 100.

Figure 10:
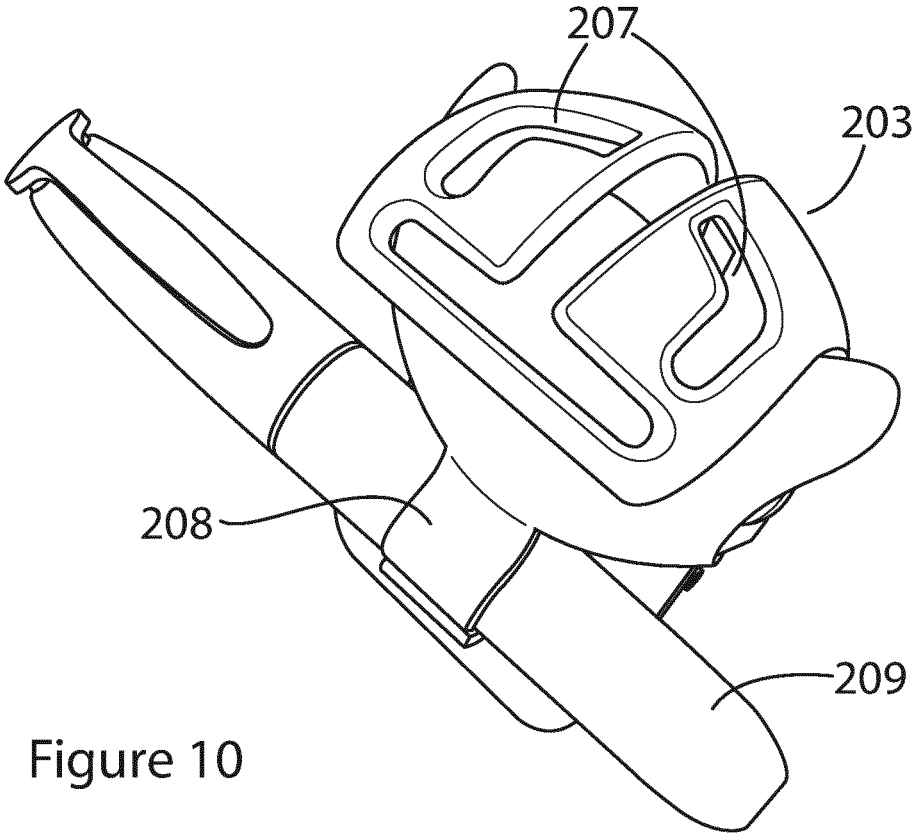
FIG. 10 shows golf ball stencil according to an embodiment of the invention.
Figure 11:
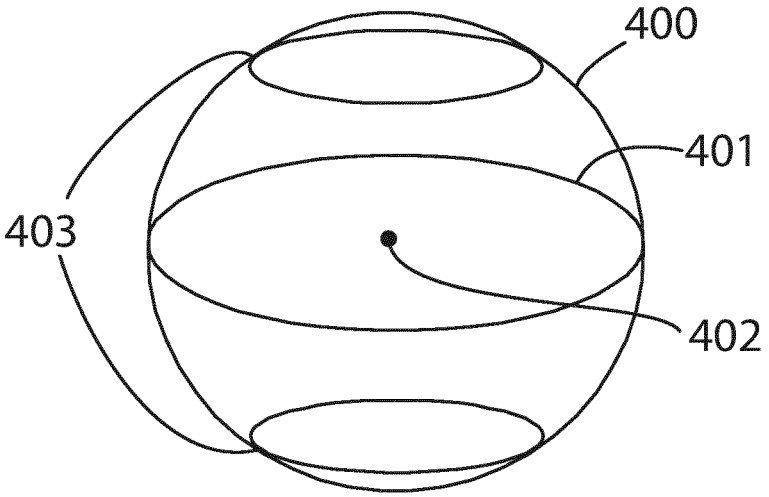
FIG. 11 shows a great circle and small circles of a sphere such as a golf ball.

The golf ball alignment tool 100 as shown in FIG. 10 may also comprise features such as a pen holder 208 for holding a pen 209 which the golfer may use to mark their score card.

The words "comprises/comprising" and the words "having/including" when used herein with reference to the present invention are used to specify the presence of stated features, integers, steps or components but do not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The invention claimed is:

1. A golf ball alignment tool for assisting a golfer in visually aligning a golf ball with a golf hole, the tool comprising:

a support base; and an alignment indicator, wherein the alignment indicator is mounted on the support base and moveable relative thereto to allow adjustment of the alignment indicator without movement of the support base, and wherein the alignment indicator includes an alignment guide positioned along a centre of the alignment indicator and along a length of a flat surface of the alignment indicator, wherein the alignment indicator is constructed and arranged to rotate or pivot relative to the support base, and wherein the support base comprises a base concave end dimensioned to receive a golf ball.

2. The golf ball alignment tool as in claim 1 wherein the alignment indicator comprises an alignment concave end wherein the alignment concave end is substantially parallel to the base concave end.

3. The golf ball alignment tool as in claim 2 wherein the alignment indicator comprises:

an alignment distal end, distal to the alignment concave end, and the alignment guide extending from the alignment concave end to the alignment distal end.

4. The golf ball alignment tool as in claim 3 wherein the alignment concave end is movable through a smaller distance than the alignment distal end.

5. The golf ball alignment tool as in claim 1 wherein the alignment indicator comprises one or more secondary aiming lines.

6. The golf ball alignment tool as in claim 5 wherein the one or more secondary aiming lines are parallel to the alignment guide.

7. The golf ball alignment tool as in claim 6, wherein the one or more secondary aiming lines include a first secondary aiming line parallel to and on one side of the alignment guide and a second secondary aiming line parallel to and on the other side of the alignment guide.

8. The golf ball alignment tool as in claim 5 wherein the one or more secondary aiming lines are perpendicular or parallel to the alignment guide.

9. The golf ball alignment tool as in claim 1, wherein the alignment indicator comprises a rounded end facing the golf ball for aligning the alignment indicator and the golf ball.

10. A kit for aligning a golf ball comprising:

a golf ball alignment tool for assisting a golfer in visually aligning a golf ball with a golf hole, the tool comprising:

a support base; and an alignment indicator, wherein the alignment indicator is mounted on the support base and moveable relative thereto to allow adjustment of the alignment indicator without movement of the support base, wherein the alignment indicator includes an alignment guide positioned along a centre of the alignment indicator and along a length of a flat surface of the alignment indicator, wherein the alignment indicator is constructed and arranged to rotate or pivot relative to the support base, and wherein the support base comprises a base concave end dimensioned to receive a golf ball.

11. The kit for aligning a golf ball according to claim 10 wherein the alignment guide and a main ball alignment line of a marking applied to the golf ball are alignable to form a main alignment indicator.

12. The kit for aligning a golf ball according to claim 11 wherein the alignment indicator includes one or more secondary aiming lines that are alignable with one or more secondary ball alignment lines of the golf ball to form secondary alignment indicators.

13. A golf ball alignment tool for assisting a golfer in visually aligning a golf ball with a golf hole, the tool comprising:

a support base; and an alignment indicator, wherein the alignment indicator is mounted on the support base and moveable relative thereto to allow adjustment of the alignment indicator without movement of the support base, and wherein the alignment indicator includes an alignment guide positioned along a centre of the alignment indicator and along a length of a flat surface of the alignment indicator, wherein the support base comprises a base concave end dimensioned to receive a golf ball.

14. The golf ball alignment tool as in claim 13 wherein the alignment indicator comprises an alignment concave end wherein the alignment concave end is substantially parallel to the base concave end.

15. The golf ball alignment tool as in claim 14 wherein the alignment indicator comprises:

an alignment distal end, distal to the alignment concave end, and the alignment guide extending from the alignment concave end to the alignment distal end.

16. The golf ball alignment tool as in claim 15 wherein the alignment concave end is movable through a smaller distance than the alignment distal end.

17. The golf ball alignment tool as in claim 13 wherein the alignment indicator comprises one or more secondary aiming lines.

18. The golf ball alignment tool as in claim 17 wherein the one or more secondary aiming lines are parallel to the alignment guide.

* * * * *